US006131295A

United States Patent [19]

Cranston

[11] Patent Number: 6,131,295

[45] Date of Patent: Oct. 17, 2000

[54] REAR SIGHT FOR ARCHERY BOW

[76] Inventor: Stephen H. Cranston, 12925 SE. Flavel St., Portland, Oreg. 97236

[21] Appl. No.: 09/058,019

[22] Filed: Apr. 9, 1998

[51] Int. Cl.[7] ..... F41G 1/467

[52] U.S. Cl. ..... 33/265; 124/87; 124/90

[58] Field of Search ..... 33/265, 241; 124/86, 124/87, 90

[56] References Cited

U.S. PATENT DOCUMENTS

| | | | |
|---|---|---|---|
| 209,233 | 10/1878 | Cox | 24/135 R |
| 295,252 | 3/1884 | Hutchins | 24/114.5 |
| 947,992 | 2/1910 | Jegge | 54/74 |
| 1,298,898 | 4/1919 | Collier | 24/114.5 |
| 1,402,450 | 1/1922 | Setty | 24/114.5 |
| 1,885,962 | 11/1932 | Swenson et al. | 124/90 |
| 2,900,617 | 8/1959 | Hixon | 439/804 |
| 3,410,644 | 11/1968 | McLendon | 356/247 |
| 3,618,586 | 11/1971 | Current | 124/87 |
| 3,678,590 | 7/1972 | Hayward | 33/241 |
| 3,698,092 | 10/1972 | Rosenhan | 33/241 |
| 3,703,770 | 11/1972 | Sofield | 33/265 |
| 3,703,771 | 11/1972 | Saunders | 33/265 |
| 3,859,733 | 1/1975 | Chesnick | 33/265 |
| 4,011,853 | 3/1977 | Fletcher | 124/87 |
| 4,116,194 | 9/1978 | Topel | 124/87 |
| 4,552,121 | 11/1985 | Treaster | 124/87 |
| 4,563,821 | 1/1986 | Saunders | 33/265 |
| 4,625,422 | 12/1986 | Carlson | 33/265 |
| 4,656,746 | 4/1987 | Gillespie | 33/265 |
| 4,656,747 | 4/1987 | Troncoso | 33/265 |
| 4,833,786 | 5/1989 | Shores, Sr. | 33/265 |
| 4,860,458 | 8/1989 | Ernstsen | 33/265 |
| 4,961,264 | 10/1990 | Topel | 33/265 |
| 4,965,938 | 10/1990 | Saunders | 33/265 |
| 5,107,596 | 4/1992 | Snyder | 33/265 |
| 5,157,839 | 10/1992 | Beutler | 33/265 |
| 5,231,765 | 8/1993 | Sherman | 33/241 |
| 5,347,976 | 9/1994 | Saunders | 33/265 |
| 5,379,747 | 1/1995 | Morris et al. | 33/265 |
| 5,435,068 | 7/1995 | Thames et al. | 33/265 |
| 5,450,673 | 9/1995 | Denton | 33/265 |
| 5,542,186 | 8/1996 | Saunders | 33/265 |
| 5,619,801 | 4/1997 | Slates | 33/241 |
| 5,638,604 | 6/1997 | Lorocco | 33/241 |
| 5,762,059 | 6/1998 | Strope | 124/87 |
| 5,819,423 | 10/1998 | Kamola | 33/265 |
| 5,894,672 | 4/1999 | Ellenburg et al. | 33/265 |
| 5,979,427 | 11/1999 | Chalin et al. | 124/87 |
| 5,996,569 | 12/1999 | Wilson | 124/87 |
| 6,024,079 | 2/2000 | Ingle et al. | 124/87 |

FOREIGN PATENT DOCUMENTS 1300273 of 1962 France .

*Primary Examiner*—Andrew H. Hirshfeld
*Assistant Examiner*—R. Alexander Smith
*Attorney, Agent, or Firm*—Klarquist Sparkman Campbell Leigh & Whinston, LLP

[57] ABSTRACT

A rear sight is adapted to be mounted on the bowstring of an archery bow having a front sight mounted on the bow. The rear sight includes a body adapted to be mounted on the string in a region which will generally be aligned with the user's eye when the string is drawn. A pair of vertically spaced apart illuminated sighting elements on the body with a non-illuminated region therebetween denote a region to be aligned with the front sight for aiming the bow.

44 Claims, 4 Drawing Sheets

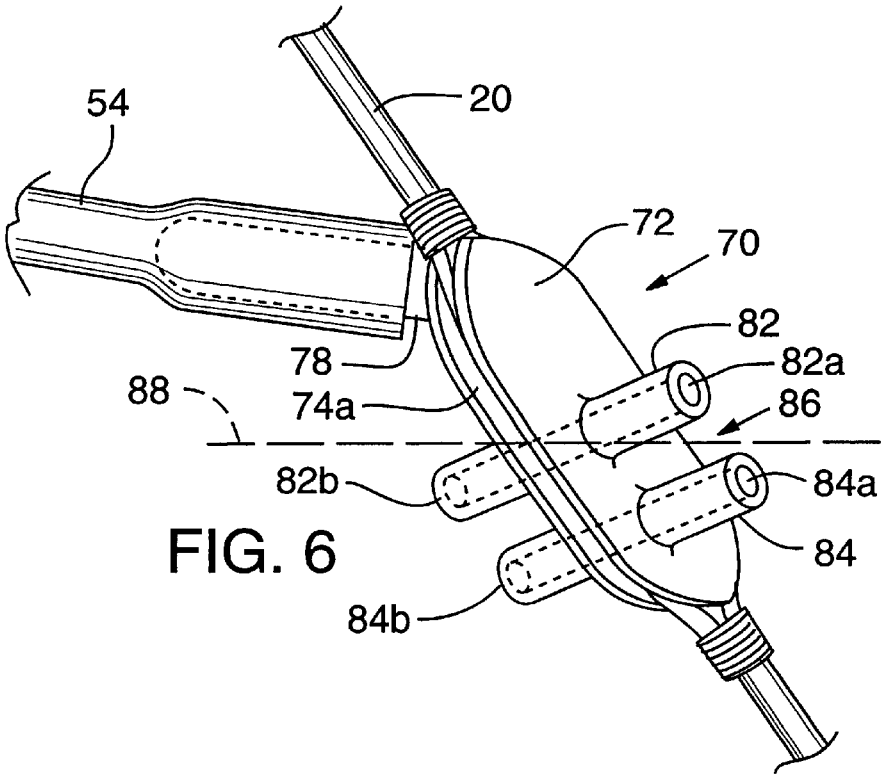
FIG. 6
FIG. 7
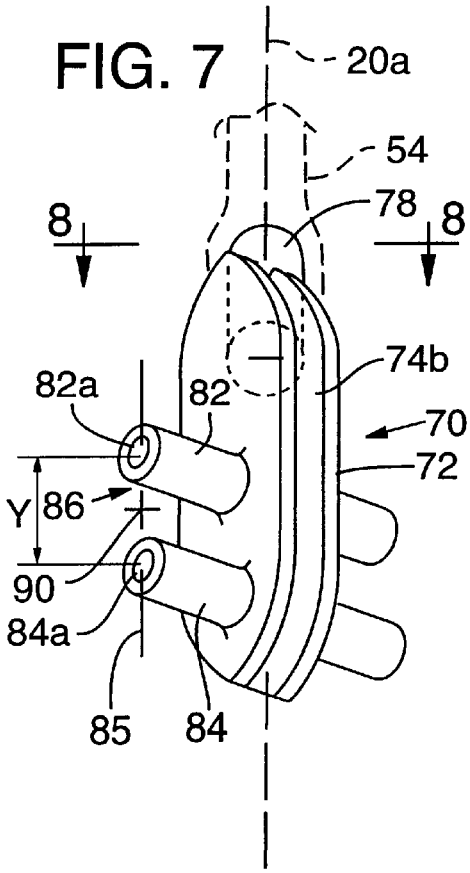
FIG. 8
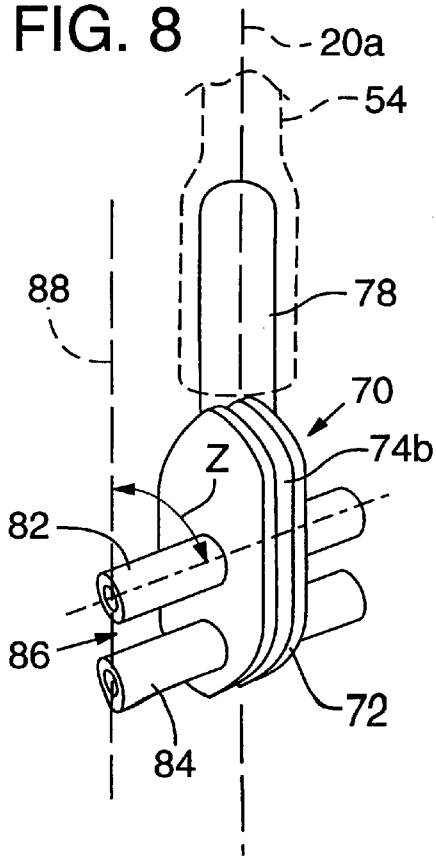

20
130
124
126
100
104
102
106b
106
106a
Y
110
108a
108
108b
118
130

20
124
130
128
114
104
116
102
106a
100
108a
106b
116
11
11
118
130
108b 108
106
108a
106a
104
108b
106b
102
116a
100
120
116
122
20

REAR SIGHT FOR ARCHERY BOW

BACKGROUND OF THE INVENTION

The present invention relates generally to apparatus for archery bow sighting, and more particulary, to a rear sight mounted on the bowstring.

When sighting an archery bow the archer often will have a front, or fore, sight mounted on the bow and a rear sight mounted on the bowstring which is drawn to a position close to the user's eye when the bow is drawn for firing. The archer sights past the rear sight to the front sight along an aiming line extending generally forwardly from the bowstring toward the bow in the direction of intended arrow flight.

In the past there have been many attempts to provide rear sights mounted on the bowstring and many have been developed which work well in bright light conditions. However, there do not appear to be rear sights which function well in low light conditions, such as may be found at dawn and dusk, and when shooting indoors in only moderately lighted archery galleries which provide "video shoots" in which a target is projected on a screen. In such conditions there is only minimal ambient light and it is difficult for the archer to sight properly.

Attempts have been made to provide front sights for low light conditions using light gathering optical fibers to provide discrete points of light at the bow, one of which is intended to be aligned with the target during aiming.

For the rear sight, attempts have been made to design illuminated sights where a single lighted region or lighted cross configuration is provided. It is intended that this lighted region or cross is to be aligned with the target. However, when such is drawn near to the user's eye in a low light condition the lighted region is not well defined and blurs so that it is difficult to align with a front sight and the target region.

SUMMARY OF THE INVENTION

An object of the present invention is to provide a novel rear sight for an archery bow which has a body adapted to be mounted on a bowstring in a region which will be generally aligned with the user's eye when the string is drawn and a pair of vertically-spaced apart illuminated sighting elements on the body with a non-illuminated region therebetween denoting a region to be aligned with the front sight for aiming the bow. With such a rear sight the user may draw it close to his eye for aiming and the illuminated sighting elements, although they become somewhat indistinct upon being drawn near to the eye, do define a non-illuminated area therebetween which may be aligned with the front sight and the target.

Another object of the present invention is to provide such a novel rear sight in which the illuminated sighting elements are elongated optical fibers positioned for light gathering and transmit gathered light to an illuminated end thereof which, when the bow is drawn, is positioned in the field of view of the user.

Yet another object of the present invention is to provide a novel rear sight in which optical fiber elements are directed such that their illuminated outer ends are directed toward a user's eye during operation.

Still another object of the invention is to provide a novel rear sight in which the optical fibers are encased in an elongate tubular cover which is constructed to permit ambient light to pass therethrough to be gathered by said optical fibers.

A further object of the present invention is to provide novel means for mounting the rear sight on a bowstring. In one embodiment this takes the form of a body which may be mounted within the strands of a bowstring. In another embodiment the body comprises of sleeve mounted for rotation on the bowstring. In yet another embodiment a saddle portion of the body is adapted to engage one side of a bowstring and has a cam locking device positioned to engage the opposite side of the string to retain the body on the string.

These and others objects and advantages of the invention will become more clearly apparent as the following description is read in conjunction with the drawings.

BRIEF DESCRIPTION OF THE DRAWINGS

FIG. 6 is an enlarged perspective side view of a rear sight constructed according to a second embodiment of the invention mounted on a bowstring;

FIG. 7 is rear view of the sight of FIG. 6 as seen by a user;

FIG. 8 is a top view of the sight of the FIG. 6;

DESCRIPTION OF PREFERRED EMBODIMENTS

Figure 1:
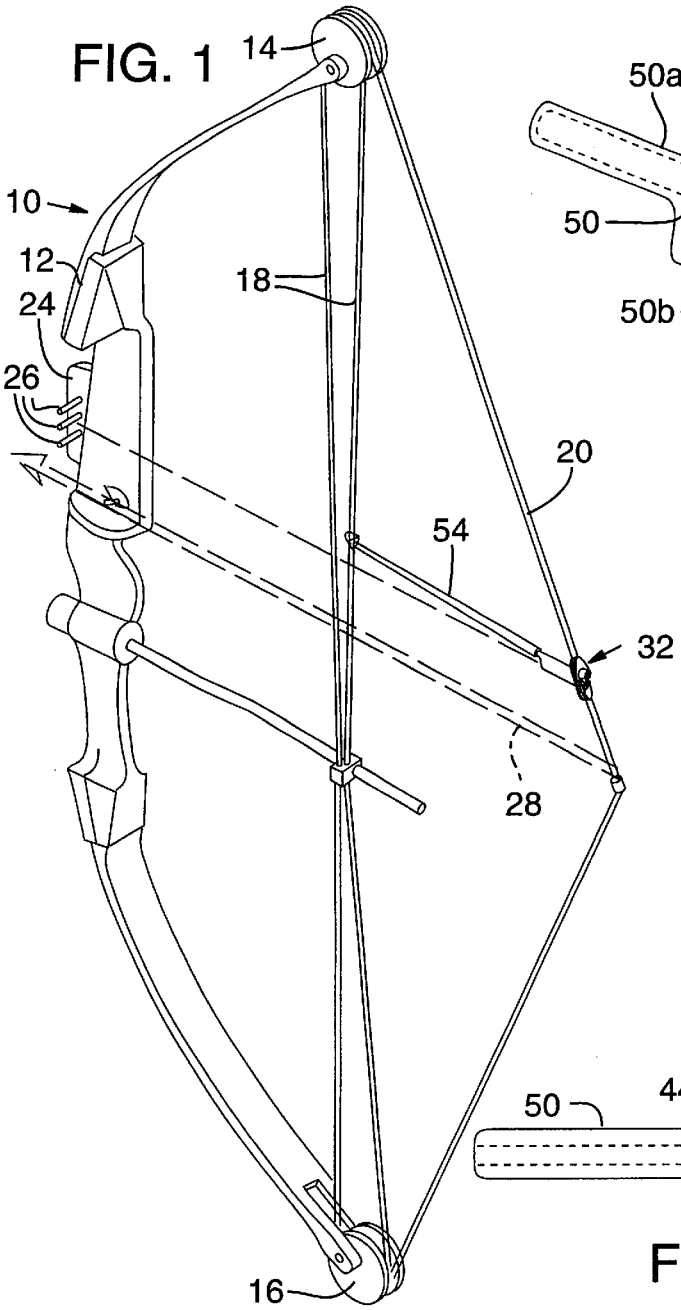
FIG. 1 is a rear perspective view of an archery bow having a rear sight according to an embodiment of the invention mounted on the bowstring.

Referring first to FIG. 1, at 10 is indicated generally an archery bow having a main bow portion 12. At upper and lower ends of the bow, pulleys 14, 16 are mounted about which cables 18 and a bowstring 20 are reeved.

Mounted on a central portion of bow 12 is a front sight 24 having a plurality of horizontally disposed and vertically-spaced apart aiming pins 26.

An elongate arrow is illustrated in dashed outline at 28 nocked on the bowstring and extending forwardly past a side of the bow in a region below aiming pins 26. The bowstring 20 is shown in a drawn position. In such position an archer's cheek would be adjacent the portion of the bowstring upon which the arrow is nocked.

A rear sight according to a first embodiment of the present invention is indicated generally at 32 mounted on the bowstring above the arrow and in a position which would be adjacent the archer's eye for aiming. A sighting line 31 is illustrated extending from rear sight 32 to foresight 24 substantially parallel to arrow 28 and its intended direction of flight.

Figure 2:
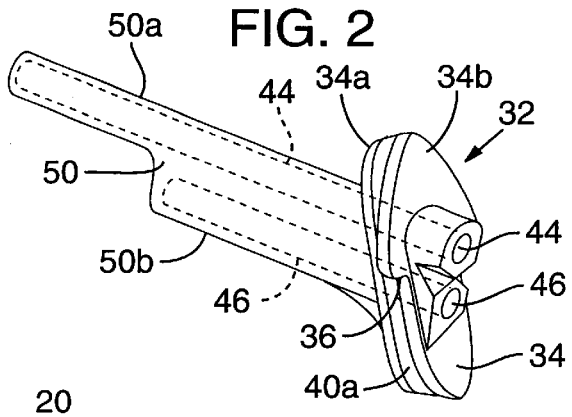
FIG. 2 is an enlarged perspective view of the sight removed from the bowstrings.
Figure 3:
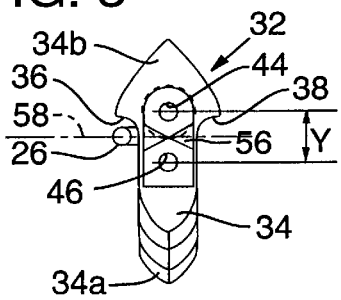
FIG. 3 is a rear elevation view of the sight.
Figure 4:
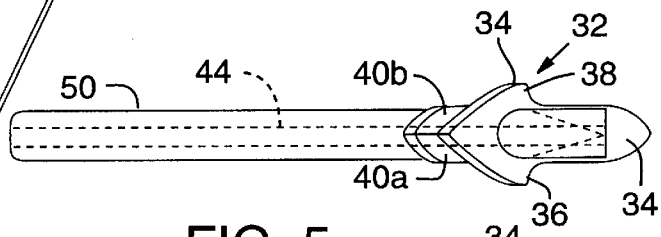
FIG. 4 is top plan view of the sight.

The rear sight 32 is illustrated in greater detail in FIGS. 2–5. The rear sight includes a body portion 34 which has a somewhat oval-shaped forward portion 34*a* and a somewhat arrowhead-shaped rear portion 34*b* as seen from the rear as illustrated in FIG. 3. The body has sighting openings 36, 38 at opposite sides thereof intermediate its upper and lower ends defined by the lower margins of the arrowhead shape and upright side margins therebelow. These openings could also be notches with both upper and lower margins.

Elongate channels 40*a,* 40*b* are formed along opposite sides of the body. These channels permit the rear sight to be mounted in the strands of a bowstring. Explaining further, bowstring 20 is comprised of at least a pair of twisted strands which may be separated at a desire point along its longitudinal length and the body 34 inserted therein, with the strands of the bowstring received in channels 40*a,* 40*b*. String-like serving may be wrapped around the bowstring above and below the rear sight body to secure the body in a selected position longitudinally of the bowstring.

A pair of vertically-spaced apart elongate upper and lower optical fiber, or fiberoptic elements, also referred to as sighting elements, 44, 46 extend through body 34. Body 34 has a central plane indicated generally at 34*c* in FIG. 5 and the optical fiber elements 44, 46 are disposed at an angle X, in a range of 110 to 160 degrees, relative to the central plane 34*c*.

Figure 5:
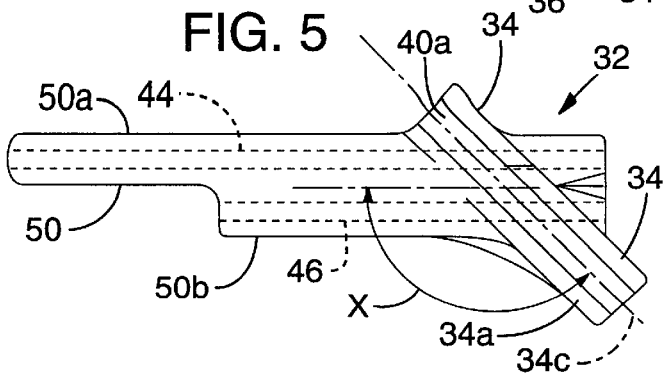
FIG. 5 is a side elevation view of the sight.

The fiberoptic elements are encased in an elongate tubular cover 50 which is constructed of a material to permit ambient light to pass therethrough to the optical fibers. The material of cover 50 may be semi-transparent nylon which is substantially rigid to prevent flexing of the cover and the optical fiber elements during use. As is seen in FIGS. 2 and 5, an upper portion 50*a* of cover 50 and optical fiber element 44 are longer than lower portion 50*b* of the cover and optical fiber 46. The distal end of cover portion 50*a* remote from body 34 provides a projection to which an elongate elastomeric element 54 (see FIG. 1) may be attached. The opposite end of element 54 is attached, as by tying, to an element spaced forwardly from the bowstring, in this instance one of cables 18. The purpose of element 54 is to urge the rear sight into proper orientation, or alignment, for aiming as the bowstring is drawn, as will be explained in greater detail below.

Referring again to fiberoptic elements 44, 46 each has a diameter, or side-to-side dimension, preferably in a range of from 0.030 inch to 0.080 inch. More preferably this range may be between 0.040 to 0.060 inch. They are spaced apart vertically by a distance Y in a range of 0.120 to 0.220 inch, and more preferably approximately 0.160 inch center-to-center. The non-illuminated region between the ends of the fiberoptic elements has a height in a range of 0.050 to 0.250 inch. The fiberoptic elements in this illustrated embodiments have lengths in a range of 0.75 to 2.0 inches. In other embodiments the lengths may be in a range of 0.5 to 1.4 inch.

The ends of the optical fiber elements visible in FIGS. 2 and 3 will be illuminated by the gathering of ambient light and will provide two lighted regions visible to the archer. The region between the illuminated ends of the fiberoptic elements indicated generally at 56 is centered on a horizontal line 58.

Describing optical fiber elements 44, 46 in greater detail, they are light collecting and conductor elements which are constructed of a light collecting plastic or polymer which includes a flourescent ingredient. Such optical fiber elements are well known. As is known they are capable of gathering light, in this case from ambient surroundings, and transmitting such gathered light to their opposite ends, with the ends visible in FIGS. 2 and 3 being substantially illuminated even in low ambient light conditions.

In use, an archer will draw the bowstring as illustrated in FIG. 1 with an arrow nocked thereon, elastomeric element 54 will be drawn taught which aligns cover 50 and fiberoptic elements 44, 46 on a line extending between bowstring 20 and one of cables 18 to which the elastomeric element is connected. This places the rear sight in proper orientation for aiming. As viewed in FIG. 3, the rear sight will be near the archer's aiming eye. The archer can view a front aiming post 26 through a side opening 36. Optical fiber elements 44, 46 provide vertically spaced apart illuminated points adjacent the archer's eye with a non-illuminated region on line 58. The archer uses the non-illuminated region between the upper and lower fiberoptic elements as a guide to aiming in low light conditions.

The fiberoptic light gathering elements 44, 46 may be sufficiently large that they gather light and produce sufficient illumination to be easily seen during use. However, as noted previously, such illuminated elements may become blurred, or indistinct, when brought close to the user's eye. This is particularly so when the user is trying to focus his view on a distant target. The sight of the present invention provides a non-illuminated region between and bounded by the illuminated fiberoptic element ends. The non-illuminated region is visually distinct between the illuminated ends and provides a defined region along which the user aims.

Referring to FIGS. 6–8, a second embodiment of the rear sight is indicated generally at 70. Sight 70 includes a substantially oval body 72 having elongate indented side channels 74*a,* 74*b* in which strands of bowstring 20 may be received to mount the sight on the bowstring, as previously described for rear sight 32.

An elongate projection 78 secured to and projecting at an angle outwardly from a forward side of body 72 is adapted to be attached to elastomeric element 54 as previously described. Here it is seen that elastomeric element 54 is a tube which fits tightly on projection 78.

A pair of elongate vertically-spaced upper and lower sighting elements 82, 84 extend through and project outwardly from opposite sides of body 72. The sighting elements 82, 84 are substantially parallel to each other and have a space 86 therebetween.

Each sighting element 82, 84 includes an elongate optical fiber element 82*a,* 84*a,* encased in surrounding tubular covers 82*b,* 84*b,* respectively. Covers 82*b,* 84*b* are constructed to allow ambient light to pass therethrough into the optical fiber element which it houses. The optical fiber elements gather ambient light and direct it to the ends which are visible to the user in FIGS. 6, 7, and 8. These illuminated ends of the fiberoptic elements provide illuminated spots, or regions in the archer's field of view during aiming, with the non-illuminated space 86 disposed therebetween.

In FIG. 8 the central longitudinal axis of the bowstring 20 is indicated generally by dashed line 20*a* and an aiming line which extends from a region adjacent the bowstring to a region adjacent the bow parallel to the intended line of flight for the arrow is indicated generally at 88. The sighting elements 82, 84 extend rearwardly from the body of the sight and are directed at an angle toward a user's eye at an angle relative to sight line 88 indicated generally at Z which may be in range of from 10 to 55 degrees, and preferably about 45 degrees. Further, as is illustrated in FIG. 7, the illuminated ends of the fiberoptic elements are aligned substantially vertically along a vertical line 85 above and below non-illuminated region, or space, 86.

In use of the rear sight as illustrated in this embodiment, the user draws the bowstring 20, elastomeric element 54 urges the rear sight to a selected orientation for sighting, and the user recognizes two illuminated points, or regions, defined by the ends of optical fiber elements 82*a,* 84*a,* with a non-illuminated region 86 therebetween. The position of the front sight pin is indicated by a cross 90 in FIG. 7, aligned between the illuminated ends of fiberoptic elements 82, 84.

Since the sighting elements 82, 84 have substantial length, in that they extend through and project outwardly to opposite sides of body 72, they are capable of gathering adequate ambient light for the fiberoptic elements to provide good illumination of the ends of elements 82*a,* 84*a,* for sighting.

Figure 9:
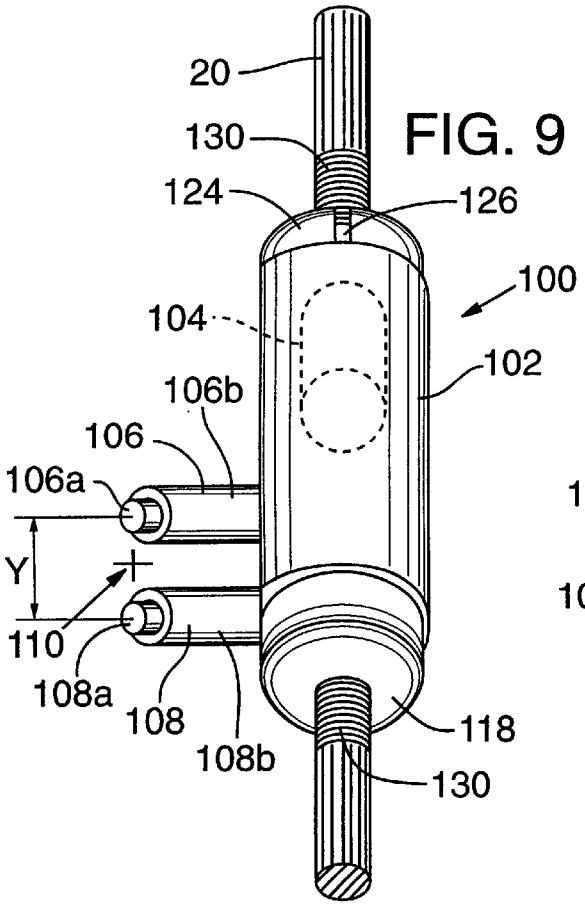
FIG. 9 is a rear view of a rear sight according to a third embodiment of the invention mounted on a bowstring and as seen by a user.
Figure 10:
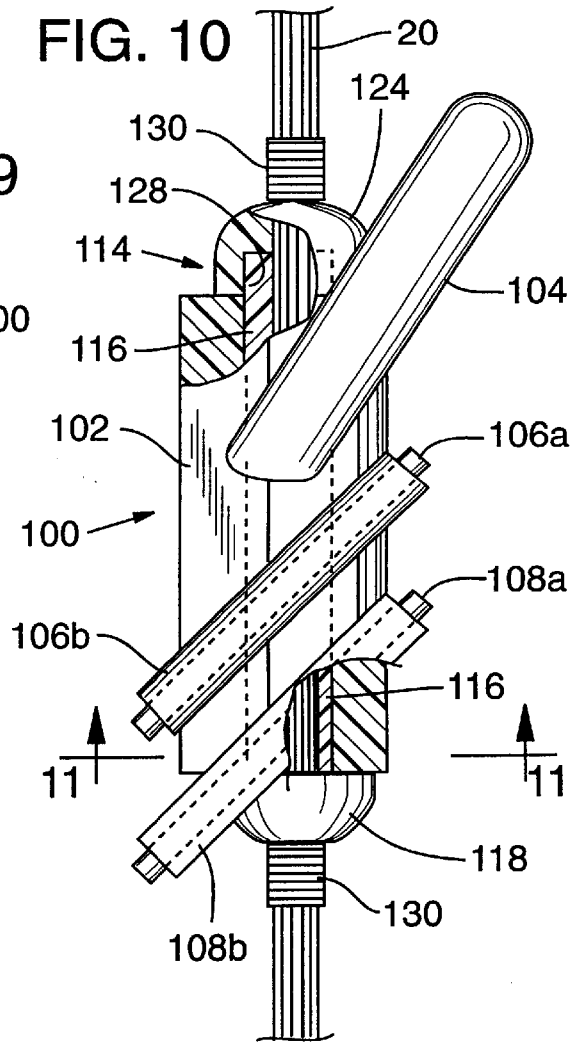
FIG. 10 is a front view of the sight of claim 9.
Figure 11:
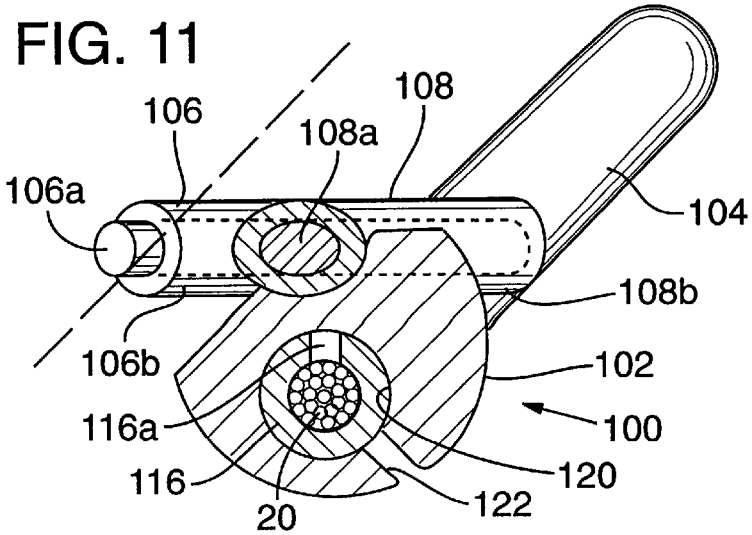
FIG. 11 is a cross-sectional view taken generally along the line 11—11 in FIG. 10.
Figure 12:
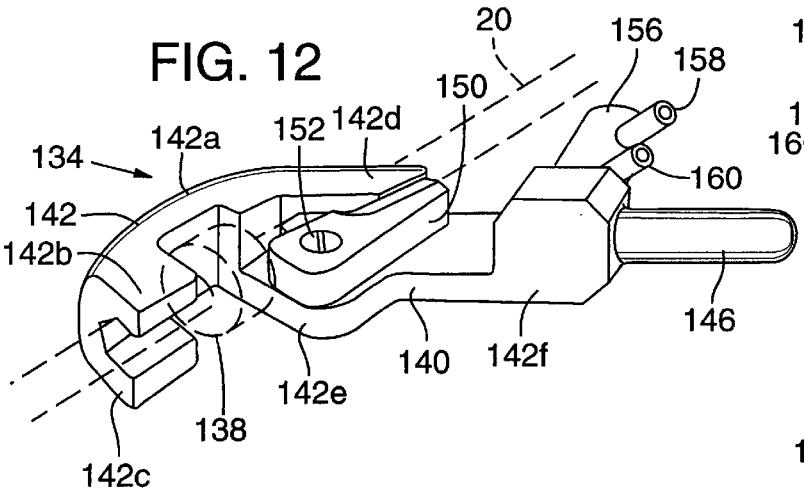
FIG. 12 is a bottom perspective view of a fourth embodiment of a rear sight according to the invention, with a bowstring extending therethrough shown in dashed outline.

A third embodiment of the rear sight invention is indicated at 100 in FIGS. 9–11. The rear sight 100 includes an elongate body 102, mounted on bowstring 20 for swiveling about the longitudinal axis of the bowstring. At 104 is noted a projection secured to and extending at an angle forwardly from sleeve 102. Projection 104 is adapted to be connected to elastomeric element 54, such that when the bowstring is drawn as illustrated in FIG. 1, projection 104 will be urged to align generally parallel to the line of sight and swivel body 102 to a proper position for aiming as will be discussed below.

A pair of upper and lower elongate sighting elements 106, 108 are secured to the outer portion of body 102 and are disposed at such an angle that when the bowstring is drawn as illustrated in FIG. 1, they will extend substantially horizontally and be directed at an angle toward the user's eye as illustrated in FIG. 9.

Sighting elements 106, 108 each include an elongate fiberoptic element 106*a,* 108*a* encased in an elongate tubular cover 106*b,* 108*b,* respectively. As in the prior embodiments the tubular covers are constructed to permit light to pass therethrough such that ambient light may be gathered by the fiberoptic elements and illuminate the ends directed toward the user's eye as illustrated in FIG. 9.

A non-illuminated void, or space, 110 is provided between sighting elements 106, 108.

Referring to FIGS. 10 and 11, body 102 is mounted on a spindle mount indicated generally at 114. The spindle mount includes an elongate tubular member 116 which, as seen in FIG. 11 has an opening 116*a* extending fully along one side thereof permitting the tubular member to be slipped on to bowstring 20 and frictionally held thereon. One end of tubular member 116 has a stop, or cap, 118 secured thereto.

Body 102 has a cylindrical interior cavity 120 extending fully therethrough, which is of a size to fit rotatably on tubular member 116. An elongate opening 122 extending the full length of body 102, permits inserting bowstring 20 laterally into central opening 120 in the body. An upper cap, or stop, 124 has a side opening as illustrated at 126 in FIG. 9, allowing it to be slipped laterally onto bowstring 20 and has an internal cavity 128 adapted to receive and fit frictionally on the end of tubular member 116 opposite cap 118.

Assembly of the device is as follows. Tubular member 116 is fitted on bowstring 20 at one longitudinal position, and body 102 is fitted on the bowstring at another longitudinal position. The body 102 is slid longitudinally of the string onto tubular member 116 such that at the lower end of body 102 engages cap 118. The upper cap, or stop, then is placed on bowstring 20 and slid longitudinally onto its associated end of tubular member 116, with caps 118, 124 providing stops at opposite ends of body 102. String-like serving 130 is wrapped about bowstring 20 and secured in position to mount the assembly in a selected position on the bowstring.

Operation of this rear sight is somewhat similar to that described for the embodiment in FIGS. 6–8. As the bowstring is drawn the visible ends of fiberoptic elements 106*a,* 108*a* come into a region adjacent the user's eye and provide illuminated points which are vertically aligned and spaced apart. The non-illuminated space therebetween provides a sighting region through which a front sight may be aligned for aiming.

A fourth embodiment of the invention is illustrated at 134 in FIGS. 12–15. The bowstring 20 is indicated in dashed outline in FIGS. 12 and 13 and in solid line in FIG. 15. The general line of sight for aiming is indicated by dashed line 136 in FIGS. 14–15. A bead-like stop 138, is shown in dashed outline in FIG. 12 and in solid outline in FIG. 15, providing a positioning member on the bowstring for the rear sight.

This rear sight includes a body 140 which has a saddle portion 142. The saddle portion has a main section 142*a* adapted to engage the rear side of the bowstring (the side of the bowstring directed toward the user) and a pair of lower straddle legs 142*b,* 142*c,* and upper straddle legs 142*d,* 142*e,* adapted to engage opposite sides of the bowstring above and below stop 138 to maintain alignment of the body on the bowstring. Straddle leg 142*e* projects forwardly beyond the bowstring and has a block-like sight mount 142*f* thereon, from the forward portion of which a projection 146 extends. Projection 146 is adapted to be attached to elastomeric member 54 and has the same purpose as previously discussed to aid in orientation or alignment of the rear sight during use.

A locking cam 150 is mounted through a screw connector 152 to straddle leg 142*e.* The locking cam is removed to allow inserting the bowstring between the straddle legs with stop 138 engaging marginal portions of the straddle legs to position the sight on the bowstring. The locking cam then is reattached with screw 152 and can be shifted between a loosened position (generally out of engagement with the bowstring) illustrated in solid outline in FIG. 15 and a tightened position (engaging the bowstring) illustrated in dashed outline. This allows the locking cam to engage the bowstring to provide a selective level of engagement of the sight on the bowstring to minimize vibration of the sight relative to the string. Once the locking cam is in a selected position it may be secured in position by tightening screw 152.

Sight mount block 142*f* has a vertically disposed bore 154 formed therein which receives a support member 156. The support member extends upwardly therefrom and has elongate upper and lower sighting elements 158, 160 extending therethrough. Support member 156 is rotatable about an upright axis in bore 154 and a screw indicated generally at 162 extending laterally inwardly from a side of sight mount block 142*f* is adapted to engage a side of support member 156 and lock it in selected position for use.

Figure 13:
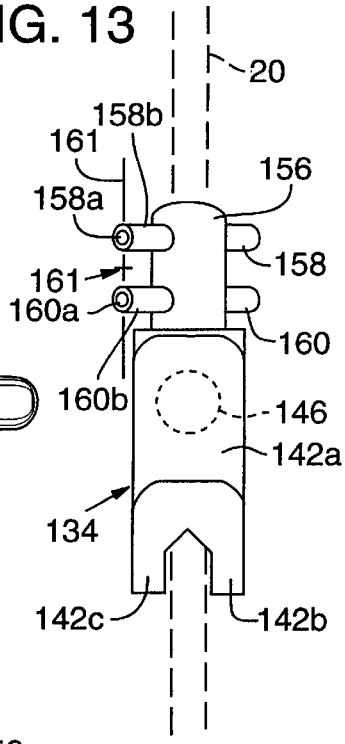
FIG. 13 is a rear view of the sight of FIG. 12 as seen by a user.
Figure 14:
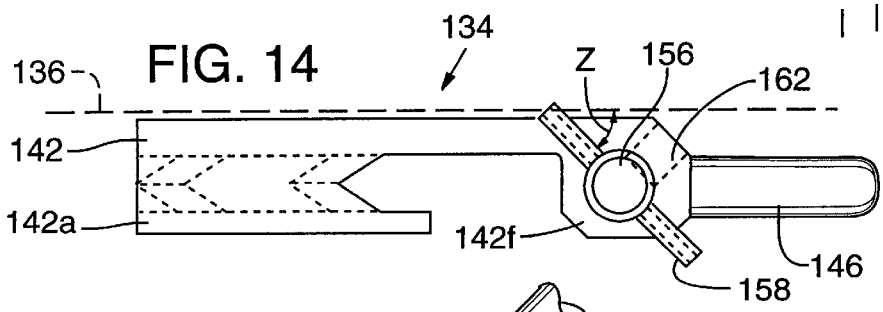
FIG. 14 is a top plan view of the rear sight of FIG. 12.
Figure 15:
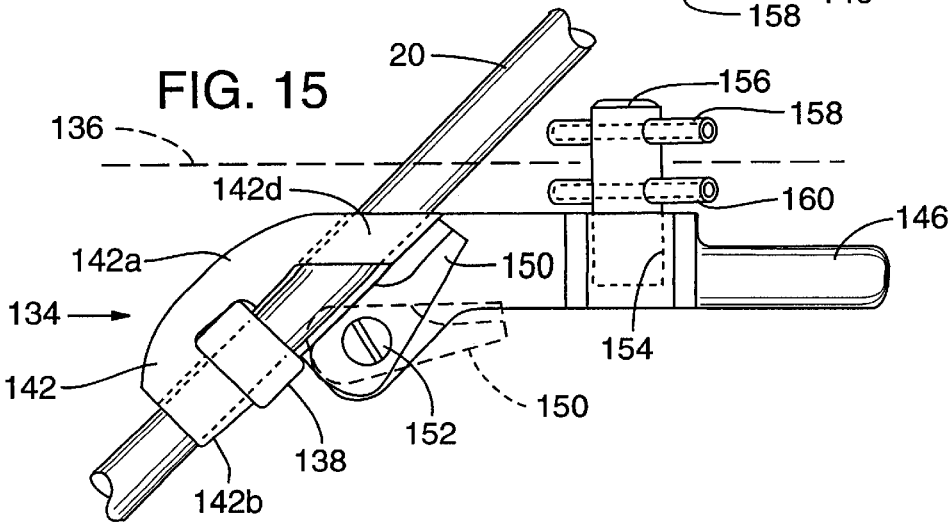
FIG. 15 is a side elevation view of the rear sight of FIG. 12.

As in prior embodiments the upper and lower sighting members include fiberoptic elements 158*a,* 160*a* and tubular encasing covers 158*b,* 160*b,* respectively. The optical fiber elements 158*a,* 160*a,* gather light transmitted through covers 158*b,* 160*b,* to illuminate the ends facing the user as seen in FIG. 13. A void, or non-illuminated space 161 is between the illuminated ends of the optical fiber elements. These elements are disposed at an angle indicated at Z relative to the sight line 136 which may be in a range of from 20 degrees to 155 degrees, and as illustrated in FIG. 14 is preferably about 45 degrees.

In use, with the rear sight mounted on the bowstring and retained in position by stop 138 and locking cam 150, drawing of the bowstring causing elastomeric element 54 to urge the rear sight into proper orientation. The user sees the illuminated ends of optical fiber elements 158*a,* 160*a,* aligned vertically above and below the sight line. It is a simple matter to align the non-illuminated space between the two illuminated regions with a foresight for aiming in low light conditions.

Although preferred embodiments of the invention have been disclosed herein, it should be apparent to those skilled in the art that variations and modifications are possible without departing from the spirit of the invention.

What is claimed:

1. A rear sight for use with an archery bow strung with a bowstring and having a front sight mounted on the bow forwardly of the bowstring, the rear sight comprising a body adapted to be mounted on the bowstring in a region which will be generally aligned with a user's eye when the bowstring is drawn, and a pair of vertically spaced apart upper and lower illuminated sighting elements on the body with a non-illuminated region therebetween denoting a region to be aligned with a front sight for aiming the bow, wherein said sighting elements are substantially aligned along an upright line and said body has a sighting opening formed in one side thereof spaced to one side of said line, said opening being aligned horizontally with said non-illuminated region.

2. The rear sight of claim 1, wherein each said sighting element comprises an elongate optical fiber having an illuminated end adapted to be positioned in the field of view of a user when the bow is upright and the bowstring is drawn.

3. The rear sight of claim 2, wherein a major portion of the length of said optical fiber is positioned for light gathering and transmits gathered light to said end.

4. The rear sight of claim 3, wherein an elongate tubular cover encases a major section of said optical fiber and is constructed to permit ambient light to pass therethrough to be gathered by said optical fiber.

5. The rear sight of claim 3, wherein the optical fiber has a side-to-side dimension in a range of 0.030 to 0.080 inch.

6. The rear sight of claim 3, wherein the sighting elements are spaced apart a distance in a range of 0.120 to 0.220 inch.

7. The rear sight of claim 3, wherein the optical fiber has a length in a range of 0.5 to 2.0 inch.

8. The rear sight of claim 3, wherein the non-illuminated region between the sighting elements has a spacing in a range of 0.050 to 0.250 inch.

9. The rear sight of claim 1, wherein said body has string-receiving channels formed on opposite sides thereof to permit mounting the body within the strands of the bowstring and said opening is formed in a portion of the body spaced laterally of said channels.

10. The rear sight of claim 1, which further comprises an element on a forward side of said body for attaching one end of an elongate elastomeric member having an opposite end attached to a component of the bow spaced forwardly of the bowstring to urge the rear sight into proper orientation for aiming.

11. A rear sight for use with an archery bow strung with a bowstring and having a front sight mounted on the bow forwardly of the bowstring, the rear sight comprising a body adapted to be mounted on the bowstring in a region which will be generally aligned with a user's eye when the bowstring is drawn, and a pair of vertically spaced apart upper and lower illuminated sighting elements on the body with a non-illuminated region therebetween denoting a region to be aligned with a front sight for aiming the bow, wherein each said sighting element comprises an elongate element projecting from said body laterally of the bowstring and of a line of sight when the bow is upright and the bowstring is drawn having an outer end which is illuminated and directed at an angle toward a user's eye, and said non-illuminated region comprises a space between said outer ends of said sighting elements through which a user may view a front sight for aiming.

12. The rear sight of claim 11, wherein said illuminated outer ends are substantially aligned along an upright line when the bow is upright and the bowstring is drawn, and a front sight is generally aligned by a user along said upright line during aiming.

13. The rear sight of claim 12, wherein the line of sight extends generally from the bowstring toward the bow, and said elongate elements extend rearwardly from the body at an angle in a range of from 10 to 55 degrees relative to said line of sight.

14. The rear sight of claim 11, wherein a first of said pair of sighting elements comprises an elongate optical fiber which extends fully through and projects outwardly from opposite sides of said body.

15. The rear sight of claim 14, wherein a second of said pair of sighting elements comprises an elongate optical fiber which extends fully through and projects outwardly from said opposite sides of said body and said first and second elements are disposed substantially parallel to each other.

16. The rear site of claim 11, wherein each said sighting element comprises an elongate optical fiber having an illuminated end adapted to be positioned in the field of view of a user when the bow is upright and the bowstring is drawn.

17. The rear sight of claim 16, wherein a major portion of the length of said optical fiber is positioned for light gathering and transmits gathered light to said end.

18. The rear sight of claim 17, wherein an elongate tubular cover encases a major section of said optical fiber and is constructed to permit ambient light to pass therethrough to be gathered by said optical fiber.

19. The rear sight of claim 11, which further comprises an element on a forward side of said body for attaching one end of an elongate elastomeric member having an opposite end attached to a component of the bow spaced forwardly of the bowstring to urge the rear sight into proper orientation for aiming.

20. A rear sight for use with an archery bow strung with a bowstring and having a front sight mounted on the bow forwardly of the bowstring, the rear sight comprising a body adapted to be mounted on the bowstring in a region which will be generally aligned with a user's eye when the bowstring is drawn, and a pair of vertically spaced apart upper and lower illuminated sighting elements on the body with a non-illuminated region therebetween denoting a region to be aligned with a front sight for aiming the bow, wherein said body comprises a rototable sleeve mounted for rotation about said bowstring said pair of sighting elements being mounted on said sleeve.

21. The rear sight of claim 20, which further comprises a spindle mount adapted to be secured to the bowstring and said sleeve is mounted on the spindle mount for rotation about an axis substantially parallel to the axis of the bowstring.

22. A rear sight for use with an archery bow strung with a bowstring and having a front sight mounted on the bow forwardly of the bowstring, the rear sight comprising a body adapted to be mounted on the bowstring in a region which will be generally aligned with a user's eye when the bowstring is drawn, and a pair of vertically spaced apart upper and lower illuminated sighting elements on the body with a non-illuminated region therebetween denoting a region to be aligned with a front sight for aiming the bow, wherein said body comprises a saddle portion adapted to rest against one longitudinal side of the bowstring and a locking cam mounted to engage the opposite side of the bowstring, said cam being shiftable between a first position generally out of engagement with the bowstring and a second position for engaging the bowstring.

23. The rear sight of claim 22, which further comprises a locking mechanism for securing the cam in a selected position.

24. The rear sight of claim 22, wherein the bowstring has a stop secured in a selected position, and said saddle portion has an opening formed therein adapted to receive said stop, said opening having margin portions for engaging the stop to maintain the body at said selected position on the bowstring.

25. The rear sight of claim 22, wherein said body has a support portion extending forwardly from said saddle portion and said sighting elements are mounted on said support portion.

26. The rear sight of claim 22, wherein each said sighting element comprises an elongate element which projects from said body laterally of the bowstring when the bow is upright and the bowstring is drawn, said elongate element having an illuminated outer end and is directed at an angle toward a user's eye, said illuminated outer ends of said pair of sighting elements having a void therebetween through which a user may view a front sight for aiming.

27. A rear sight for use with an archery bow strung with a bowstring and having a front sight mounted on the bow forwardly of the bowstring, the rear sight comprising a body adapted to be mounted on the bowstring in a region which will be generally aligned with a user's eye when the bowstring is drawn, said body having string-receiving channels formed on opposite sides thereof permitting mounting the body within the strands of the bowstring and a sighting opening formed along a side of the body spaced laterally outwardly of said channels and the bowstring, and a pair of vertically spaced apart upper and lower illuminated sighting elements on the body with a non-illuminated region therebetween denoting a region to be aligned with a front sight and said opening for aiming the bow, each sighting element comprising an elongate optical fiber extending through the body, having an illuminated end adapted to be positioned in the field of view of a user when the bow is upright and the bowstring is drawn, and having a major portion of its length positioned for light gathering and to transmit gathered light to said illuminated end.

28. The rear sight of claim 27, which further comprises elongate tubular covers encasing the major section of said optical fibers, said covers constructed to permit ambient light to pass therethrough to be gathered by the optical fibers.

29. A rear sight for use with an archery bow strung with a bowstring and having a front sight mounted on the bow forwardly of the bowstring, the rear sight comprising a body adapted to be mounted on the bowstring in a region which will be generally aligned with a user's eye when the bowstring is drawn, and a pair of vertically spaced apart upper and lower illuminated sighting elements on the body with a non-illuminated region therebetween denoting a space to be aligned with a front sight for aiming the bow, along a line of sight, each said sighting element comprises an elongate element projecting laterally outwardly from said body and extending rearwardly from the bowstring at an angle relative to the line of sight, said element having an illuminated outer end directed at an angle toward a user's eye, said illuminated outer ends of said pair of sighting elements being substantially aligned along an upright line when the bow is upright and the bowstring is drawn and having the space therebetween through which a user may view a front sight for aiming with said illuminated ends aligned above and below a front sight.

30. The rear sight of claim 29, wherein the line of sight extends generally from the bowstring toward the bow, and said elongate elements extend rearwardly from the body at an angle in a range of from 10 to 55 degrees relative to said line of sight.

31. The rear sight of claim 29, which further comprises an element on a forward side of said body for attaching one end of an elongate elastomeric member having an opposite end attached to a component of the bow spaced forwardly of the bowstring to urge the rear sight into proper orientation for aiming.

32. The rear sight of claim 29, wherein a first of said pair of sighting elements comprises an elongate optical fiber which extends fully through and projects outwardly from opposite sides of said body.

33. The rear sight of claim 32, wherein a second of said pair of sighting elements comprises an elongate optical fiber which extends fully through and projects outwardly from said opposite sides of said body and said first and second elements are disposed substantially parallel to each other.

34. The rear sight of claim 29, wherein said body has string-receiving channels formed on opposite sides thereof to permit mounting within the strands of the bowstring.

35. The rear sight of claim 29, wherein said body comprises a rotatable sleeve mounted for rotation on said bowstring for swiveling thereabout, said pair of sighting elements being mounted on said sleeve.

36. The rear sight of claim 35, which further comprises a spindle mount adapted to be secured to the bowstring and said sleeve is mounted on the spindle mount for rotation about an axis substantially parallel to the axis of the bowstring.

37. The rear sight of claim 36, wherein said spindle mount comprises upper and lower stops to maintain a selected position for said sleeve on the bowstring.

38. A rear sight for use with an archery bow strung with a bowstring and having a front sight mounted on the bow forwardly of the bowstring, the rear sight comprising a body adapted to be mounted on the bowstring in a region which will be generally aligned with a user's eye when the bowstring is drawn, said body has a saddle portion adapted to rest against one longitudinal side of the bowstring and a locking cam mounted to engage the opposite side of the bowstring, said cam being shiftable between a first position generally out of engagement with the bowstring and a second position for engaging the bowstring; and a pair of vertically spaced apart upper and lower illuminated sighting elements on the body with a non-illuminated region therebetween denoting a region to be aligned with a front sight for aiming the bow, each said sighting element comprising an elongate optical fiber having an illuminated outer end adapted to be positioned in the field of view of a user when the bow is upright and the bowstring is drawn.

39. The rear sight of claim 38, wherein the bowstring has a stop secured in a selected position, and said saddle portion has an opening formed therein adapted to receive said stop, said opening having margin portions for engaging the stop to maintain the body at said position on the bowstring.

40. The rear sight of claim 38, which further comprises a locking mechanism for securing the cam in a selected position.

41. The rear sight of claim 38, wherein said body has a support portion extending forwardly from said saddle portion and said sighting elements are mounted on said support portion.

42. The rear sight of claim 38, wherein said illuminated outer ends are substantially aligned along an upright line when the bow is upright and the bowstring is drawn, and a front sight is generally aligned by a user along said upright line during aiming.

43. The rear sight of claim 42, wherein a line of sight extends generally from the bowstring toward the bow, and said elongate elements extend rearwardly from the body at an angle in a range of from 10 to 55 degrees relative to said line of sight.

44. The rear sight of claim 38, which further comprises an element on a forward side of said body for attaching one end of an elongate elastomeric member having an opposite end attached to a component of the bow spaced forwardly of the bowstring to urge the rear sight into proper orientation for aiming.

* * * * *